United States Patent [19]

Lardellier

[11] Patent Number: 4,646,810

[45] Date of Patent: Mar. 3, 1987

[54] METHOD FOR THE MANUFACTURE OF A CERAMIC TURBINE RING INTEGRAL WITH A METALLIC ANNULAR CARRIER

[75] Inventor: Alain M. J. Lardellier, Melun, France

[73] Assignee: Societe Nationale d'Etude et de Construction de Moteurs d'Aviation "S.N.E.C.M.A.", Paris, France

[21] Appl. No.: 792,772

[22] Filed: Oct. 30, 1985

[30] Foreign Application Priority Data

Oct. 30, 1984 [FR] France ..... 84 16535

[51] Int. Cl.[4] ..... B22D 19/04; B22D 13/04

[52] U.S. Cl. ..... 164/98; 164/114; 415/200; 415/197; 29/156.8 R; 29/23.5; 29/DIG. 6

[58] Field of Search ..... 164/98, 99, 114, 137, 164/288; 29/156.8 R, 23.5, DIG. 6; 264/311; 415/200, 197, 196, 212 R, 212 A

[56] References Cited

U.S. PATENT DOCUMENTS

| | | | |
|---|---|---|---|
| 3,401,026 | 9/1968 | Walker et al. | 164/111 |
| 3,511,306 | 5/1970 | Warkoczewski | 164/108 |
| 4,087,199 | 5/1978 | Hemsworth et al. | 415/174 |
| 4,112,574 | 9/1978 | Deli | 164/111 |
| 4,135,851 | 1/1979 | Bill et al. | 415/200 |
| 4,377,196 | 3/1983 | Khandros | 164/114 |
| 4,426,193 | 1/1984 | Carlson | 29/156.8 R |

FOREIGN PATENT DOCUMENTS

| | | | |
|---|---|---|---|
| 2164215 | 7/1973 | France | 415/174 |
| 2371575 | 6/1978 | France | 415/174 |
| 2540938 | 2/1983 | France | 415/174 |
| 2540939 | 2/1983 | France | 415/174 |
| 7216110 | 6/1973 | Netherlands | 415/174 |

*Primary Examiner*—Nicholas P. Godici
*Assistant Examiner*—Samuel M. Heinrich
*Attorney, Agent, or Firm*—Oblon, Fisher, Spivak, McClelland & Maier

[57] ABSTRACT

A method of manufacturing a ceramic turbine ring rigid with an annular metallic carrier, which includes the steps of (a) moulding a ceramic member in a predetermined shape, (b) locating the ceramic member produced in step (a) and an annular cavity of a channel which defines a mould; (c) rotating the mould and moulding under centrifugal action a metallic material around the ceramic member, the rotation continuing until the metallic member has solidified; (d) demoulding the ceramic turbine ring part and its carrier produced in step (c) by disassembling the mould; and (e) machining the part produced by step (d) to produce the turbine ring.

9 Claims, 7 Drawing Figures

METHOD FOR THE MANUFACTURE OF A CERAMIC TURBINE RING INTEGRAL WITH A METALLIC ANNULAR CARRIER

BACKGROUND OF THE INVENTION

1. Field of the Invention

The invention relates to a method of manufacture particularly applicable to turbine rings comprising a ceramic elment rigid with an annular metallic carrier.

2. Summary of the Prior Art

The advantages of the use of ceramic materials for forming fluidtight stator rings of a turbine disposed opposite to the rotor of one stage of the turbine are well known. The low thermal conductivity of these materials enables, in practice, a remarkable effectiveness as a thermal barrier and their use thus enables construction of stator elements, in particular of the casings, such that they respond more readily to other requirements of their operation, of low cost and with easy practical application. The good resistance of ceramic materials to high temperatures enables in particular reduction or under certain circumstances omission of all cooling and to thus reduce the cooling air flow, which enables appreciable gains in efficiency. These materials also have corrosion resistance properties when hot which are advantageous in turbine rings.

Nevertheless, the extension of the use of ceramic materials to turbine rings has been retarded by various constraints based on dificulties in putting into practice ceramic materials in these applications. Ceramic materials, especially when heavy, compact, types are concerned have a poor strength when they are submitted to tensile forces. Moreover, their low coefficient of thermal expansion give rise to serious operational problems in their connections with metallic carriers. Several prior proposals have aimed at resolving these problems.

FR-A-2 371 575 describes a turbine ring in which a ceramic ring is built up by juxtaposition of segments. This proposal, however, necessitates manufacturing and assembly method which are relatively complicated and hence costly. Furthermore, inevitable discontinuities, in the region of the coupled edges of the segments are prejudicial to satisfactory gas flow.

An improvement described by FR-A-2 540 938 provides for resilient securing of the ceramic segments to a ring by one bolt of which the head transmits to the segment an axial force which applies it against the ring.

FR-A-2 559 834 provides for the use of a ceramic ring in one piece, which enables avoidance of several of the disadvantages hereinbefore referred to. The mounting method proposed in the zone of an annular carrier of wound ceramic material, enables a compressive prestress of the ceramic ring but is not however entirely satisfactory in all applications.

SUMMARY OF THE INVENTION

The method of manufacture, according to the invention, of a ceramic turbine ring enables the avoidance of the disadvantages hereinbefore referred to and also avoids the use of a supplementary ring of wound ceramic material, which renders this prior proposal more complex and also necessitates the use of connection means between the ceramic ring and its annular carrier, such as bolts and inserts.

According to the present invention there is provided a method of manufacturing a ceramic turbine ring rigid with an annular metallic carrier, comprising the following steps:

(a) moulding a ceramic member to a predetermined shape;

(b) locating the ceramic member produced in step (a) in an annular cavity of a channel which defines a mould;

(c) rotating said mould and moulding under centrifugal action a metallic material around the ceramic member, the rotation continuing until the metallic material has solidified;

(d) de-moulding the ceramic turbine ring part and its carrier produced in step (c) by disassembling said mould; and (e) machining the part produced by step (d) to produce the turbine ring.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
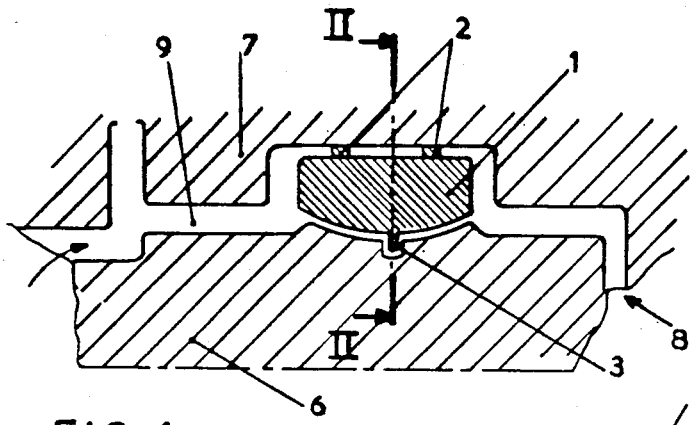
FIG. 1 illustrates, as a partial perspective and diagrammatic view in section, one stage of a method of manufacture of a turbine ring according to the invention in which a ceramic member is located in a channel also constituting a mould.
Figure 2:
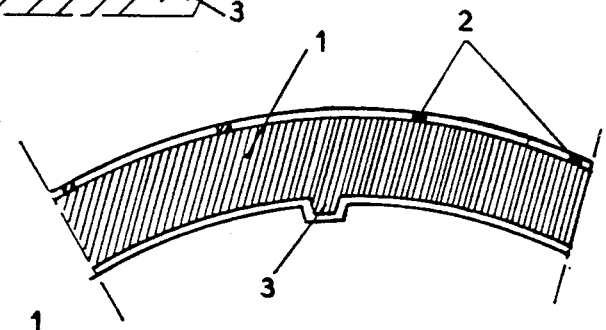
FIG. 2 illustrates a view in section taken along line II—II of FIG. 1.

The method according to the invention is intended for the production of a ceramic turbine ring rigid with a metallic annular carrier. The first stage of the method consists in a moulding operation to form a ceramic element 1 such as illustrated in FIGS. 1 and 2. The operation of moulding only employs known methods currently used for the production of moulded ceramic elements. The ceramic element 1 may form a continuous monobloc ring, as illustrated in FIGS. 1 and 2 and it comprises on its outer periphery and on its inner periphery pips or like projections 2 and 3 produced during the moulding operation.

Figure 4:
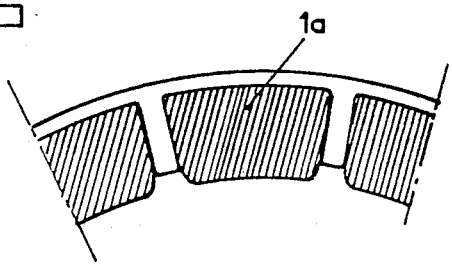
FIG. 4 illustrates a view in section taken along line IV—IV of the turbine ring of FIG. 3.
Figure 5:
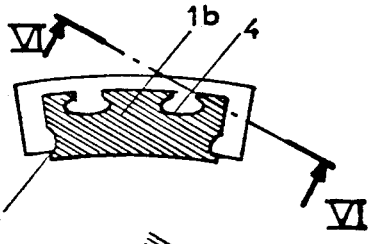
FIG. 5 illustrates, as a sectional view in a plane containing its geometrical axis, a modification of the turbine ring produced by the method in accordance with the invention.
Figure 6:
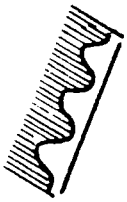
FIG. 6 illustrates a view, partially in section, taken along line VI—VI of FIG. 5.

According to the form of a turbine ring used, the ceramic elements produced by moulding can also be made in the form of segments or separate blocks, capable of being assembled to form a ring. Such segments 1*a* are illustrated in FIG. 4. Additionally to the pips 2 and 3 on the outer surfaces of the ceramic element 1, a ceramic element can be made as illustrated in FIGS. 5 and 6 such as 1*b* and comprises on its outer periphery (as assembled in the ring) anchorages 4 and possibly on the side faces of the ceramic elements anchorages 5. These anchorages 4 or 5 need not be annular and can have any shape compatible with their mode of production by moulding. The anchorages shapes can also be applied to the continuous ring as illustrated in FIGS. 1 and 2.

The ceramic element 1 thus produced and defined, as a ring or as segments, is then located between an inner part 6 and an outer part 7 defining a channel 8 leading to an annular cavity 9, the channel 8 constituting a mould for flowing material. The pips 2 and 3 hereinbefore referred to are used for locating and maintaining in place the ceramic element 1 within the annular cavity 9.

A moulding operation by centrifugal action then follows, taking care of precautions appropriate to this known method of moulding. This operation may take place under vacuum. In a further modification this moulding may be carried out in an inert atmosphere. The fused metal is introduced into the channel 8 which, during this time, is rotated about its axis. The annular cavity 9 is filled and the channel 8 is rotated until complete solidification of the metal.

Figure 3:
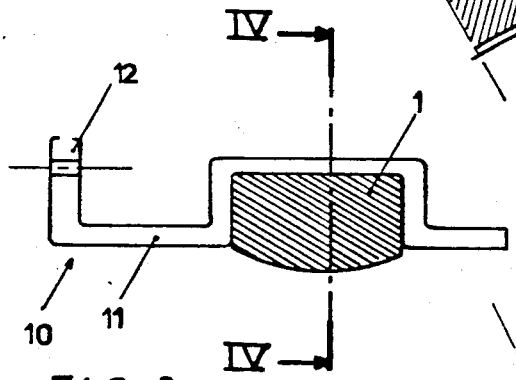
FIG. 3 illustrates, as a sectional view in a plane containing its geometrical axis, a turbine ring produced by the method in accordance with the invention.

The demoulding of the part produced is then effected by disassembly of the flow mould 8. Complementary machining operations are then necessary in order to produce a finished part having precisely dimensioned sides provided for the mounting of the part in a turbine. The finished part 10 illustrated in FIGS. 3 and 4 is thus built up from a ceramic element 1 held within a metallic carrier 11 to which this ceramic member 1 is well adhered. The metallic carrier 11 comprises one or more flange(s) such as 12 utilised for the assembly of the part in the turbine (see FIG. 3).

Figure 7:
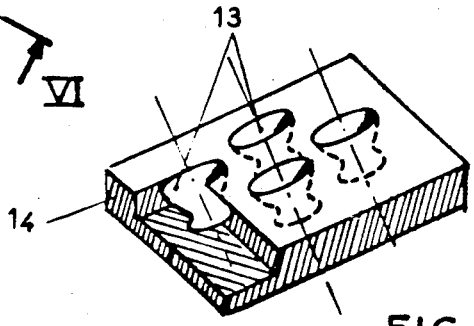
FIG. 7 is a perspective view, partly in section, of a sector of the turbine ring likewise produced by the method in accordance with the invention.

The method according to the invention which has just been described also enables the production of rings as illustrated in FIG. 7 which illustrates a sector of such a ring in which blocks of ceramic material 13 are "embedded" or locked in a metallic matrix 14 which has been produced by centrifugal moulding; these blocks can have any selected shape, of which one example is illustrated in FIG. 7 and which enables their "bedding".

Among the advantages obtaned by the method according to the invention, it must be noted that during the course of the complete solidification of the metal which follows the moulding itself, the metallic material exerts a compression force on the ceramic member 1. It follows from this that a pre-stress in compression is applied to the ceramic which may be small, and may be eliminated during operational use of the ring after mounting in a turbine, but in no case will a tension force act on the ceramic from the metallic carrier, which would have been seriously disadvantageous to long service life of the ceramic member.

It will be noted that a type of ceramic best adapted to use conditions under consideration will be selected for the manufacture of the ceramic element 1. In particular a homogeneous ceramic or composite may be used.

Various modifications of which the details for putting into practice are immediately within the grasp of the man skilled in the art will also lie within the scope of the invention. Thus the pips or projections 2 or 3 intended for locating the ceramic member 1 between the two parts 6 and 7 of the channel 8 during the operation of moulding of the metal can be replaced by other appropriate members. Similarly, the annular seating of the ceramic member 1 in the metallic carrier 11 can be of any sectional shape, rectangular or trapezoidal or any other. Moreover, the annular part 10 produced before mounting on a turbine can also be segmented by saw cuts.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of manufacturing a single piece ceramic turbine ring rigid with an annular metallic carrier, which comprises:

(a) moulding a single piece, monobloc annulus ceramic member in a predetermined shape;

(b) locating the ceramic member produced in step (a) in an annular cavity of a channel which defines a mould;

(c) rotating said mould and moulding under centrifugal action a metallic material around the ceramic member, the rotation continuing until the metallic material has solidified;

(d) de-moulding the ceramic turbine ring part and its carrier produced in step (c) by disassembling said mould; and (e) machining the part produced by step (d) to produce the single piece turbine ring.

2. A method according to claim 1, wherein the ceramic member further comprises a homogeneous ceramic material.

3. A method according to claim 1, wherein the ceramic member further comprises a composite ceramic material.

4. A method according to claim 1, which further comprises providing the ceramic member of step (a) with projections for locating and maintaining the member in the mould of steps (b) and (c).

5. A method according to claim 1, wherein the ceramic member of step (a) comprises pips and wherein the method further comprises locating and maintaining said ceramic member in location in the mould during steps (b) and (c).

6. A method according to claim 1, wherein the ceramic member produced by step (a) further comprises a plurality of anchorages and wherein said method further comprises filling said anchorages with metallic material in step (c) whereby the ceramic member is locked into the annular metallic carrier.

7. A method according to claim 6, which further comprises forming the anchorages in the outer periphery and in the side edges of the ceramic member prior to filling said anchorages with metallic material.

8. A method according to claim 1, which further comprises carrying out the moulding of step (c) under vacuum.

9. A method according to claim 1, which further comprises carrying out the moulding of step (c) in an inert atmosphere.

* * * * *